US011072981B2

(12) United States Patent
Zhou et al.

(10) Patent No.: US 11,072,981 B2
(45) Date of Patent: Jul. 27, 2021

(54) SAMPLING-BY-PUSHING SYSTEM AND SETTING METHOD THEREOF

(71) Applicant: CHINA OILFIELD SERVICES, LIMITED, Tianjin (CN)

(72) Inventors: Minggao Zhou, Sanhe Langfang (CN); Yongren Feng, Sanhe Langfang (CN); Xingfang Wu, Sanhe Langfang (CN); Yanmin Zhou, Sanhe Langfang (CN); Yongzeng Xue, Sanhe Langfang (CN)

(73) Assignee: CHINA OILFIELD SERVICES, LIMITED, Tianjin (CN)

( * ) Notice: Subject to any disclaimer, the term of this patent is extended or adjusted under 35 U.S.C. 154(b) by 32 days.

(21) Appl. No.: 16/576,799

(22) Filed: Sep. 20, 2019

(65) Prior Publication Data

US 2020/0355034 A1 Nov. 12, 2020

(30) Foreign Application Priority Data

May 10, 2019 (CN) ..... 201910389871.X

(51) Int. Cl.
*E21B 17/10* (2006.01)
*E21B 49/10* (2006.01)
*E21B 47/06* (2012.01)

(52) U.S. Cl.
CPC ..... *E21B 17/1021* (2013.01); *E21B 17/1014* (2013.01); *E21B 49/10* (2013.01); *E21B 47/06* (2013.01)

(58) Field of Classification Search
CPC ..... E21B 17/1021; E21B 49/10; E21B 47/06; E21B 17/1014; E21B 49/086; G01N 1/14
See application file for complete search history.

(56) References Cited

U.S. PATENT DOCUMENTS

2004/0011525 A1* 1/2004 Jones ..... E21B 49/008 166/264
2008/0115574 A1* 5/2008 Meek ..... E21B 49/10 73/152.03
2013/0081803 A1* 4/2013 Tao ..... E21B 17/1014 166/247

(Continued)

FOREIGN PATENT DOCUMENTS

CN 101054896 A 10/2007
CN 201225145 Y 4/2009

(Continued)

OTHER PUBLICATIONS

Office Action dated Apr. 28, 2021 for Chinese Patent Application No. 201910389871.X and English Translation.

*Primary Examiner* — Michael R Wills, III

(74) *Attorney, Agent, or Firm* — Ling Wu; Stephen Yang; Ling and Yang Intellectual Property

(57) ABSTRACT

A sampling-by-pushing system includes a setting-by-pushing mechanism and a centralizing device. The setting-by-pushing mechanism is connected with the centralizing device through a connecting pipe, and is configured to be set and sealed in a borehole. The centralizing device includes a base body and a retractable support arm arranged on the base body. The support arm is configured to be in contact with the wall of the borehole so as to position the setting-by-pushing mechanism in the center of the borehole.

11 Claims, 4 Drawing Sheets

(56) References Cited

U.S. PATENT DOCUMENTS

| | | | | |
|---|---|---|---|---|
| 2015/0068736 | A1* | 3/2015 | Dirksen | E21B 44/005 166/250.01 |
| 2016/0053612 | A1* | 2/2016 | Proett | E21B 17/1021 166/264 |
| 2018/0328827 | A1* | 11/2018 | Martysevich | G01N 3/46 |
| 2019/0003303 | A1* | 1/2019 | Donzier | E21B 47/085 |

FOREIGN PATENT DOCUMENTS

| | | | |
|---|---|---|---|
| CN | 201539253 | U | 8/2010 |
| CN | 104329083 | A | 2/2015 |
| CN | 204457486 | U | 7/2015 |
| CN | 205172570 | U | 4/2016 |
| CN | 205876262 | U | 1/2017 |
| CN | 107269228 | A | 10/2017 |
| JP | 2001013065 | A | 1/2001 |

* cited by examiner

A-A

SAMPLING-BY-PUSHING SYSTEM AND SETTING METHOD THEREOF

CROSS-REFERENCE TO RELATED APPLICATION

This application claims the priority to Chinese patent application No. 201910389871.X filed May 10, 2019, the entirety of which is hereby incorporated by reference.

TECHNICAL FIELD

The embodiments of the application relate to, but are not limited to, an oil exploration tool, in particular to, but are not limited to, a sampling-by-pushing system and a setting method thereof.

BACKGROUND

In the process of oil development, it is needed to measure the fluid pressure inside the formation and extract fluid samples from formation to accurately determine the location of the oil layer so as to facilitate oil exploitation. At present, during the setting and sealing of the tool for formation pressure measurement and fluid sampling available in the market after it is lowered into the borehole, the tool may be not centered during the setting and sealing due to different sizes of the boreholes, thus affecting the setting effect of the tool and causing errors in formation pressure measurement and fluid sampling.

SUMMARY

The following is an overview of the subject matter described in detail herein. This summary is not intended to limit the protection scope of the claims.

The embodiments of the application provide a sampling-by-pushing system and a setting method thereof.

In order to achieve the purpose of the application, the embodiments of the application provide the following technical schemes.

A sampling-by-pushing system includes a setting-by-pushing mechanism and a centralizing device. The setting-by-pushing mechanism is connected with the centralizing device through a connecting pipe, and is configured to be set and sealed in a borehole. The centralizing device includes a base body and a retractable support arm arranged on the base body. The support arm is configured to be in contact with the wall of the borehole so as to position the setting-by-pushing mechanism in the center of the borehole.

A method for setting the sampling-by-pushing system includes: lowering the sampling-by-pushing system into the borehole; controlling the support arm of the centralizing device to extend outwardly so as to contact with the wall of the borehole, and enabling the setting-by-pushing mechanism to be positioned in the center of the borehole by controlling the extension and retraction of the support arm; and controlling the setting-by-pushing mechanism to set and seal within the borehole.

Other features and advantages of the present application will be set forth in the following description.

BRIEF DESCRIPTION OF DRAWINGS

The drawings are provided for further understanding of the technical schemes of the present application and constitute a part of the description, and together with the embodiments of the application, are used for explaining the technical schemes of the application without limiting the same.

DETAILED DESCRIPTION

Hereinafter, embodiments of the present application will be described in detail with reference to the accompanying drawings.

Figure 1:
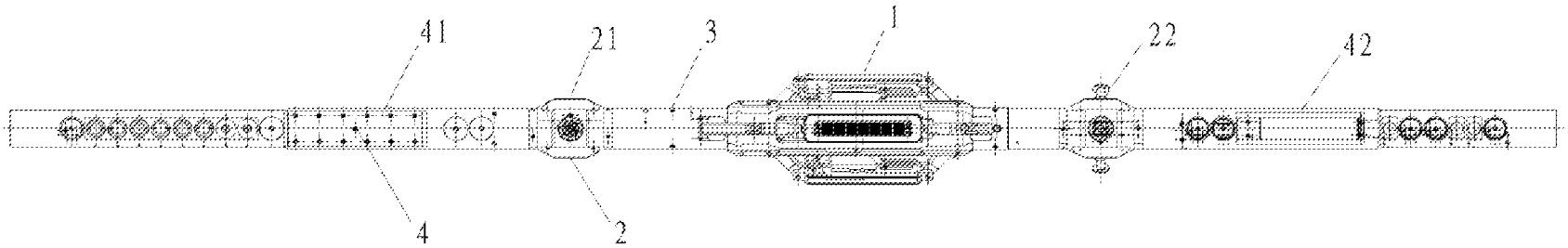
FIG. 1 is a cross-sectional view of a sampling-by-pushing system provided by an embodiment of the present application.
Figure 2:
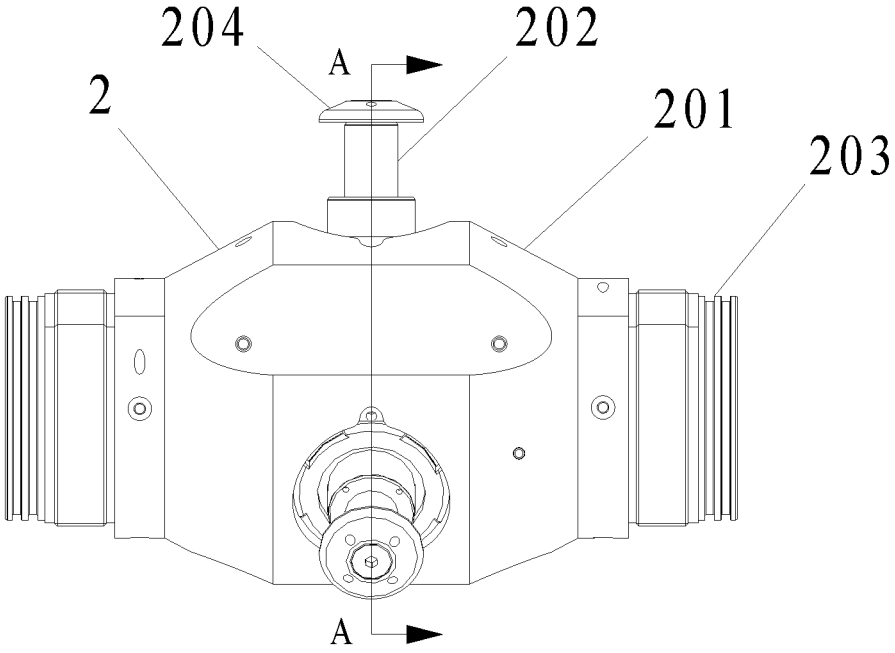
FIG. 2 is a schematic structural view of the centralizing device in the embodiment of the application.
Figure 3:
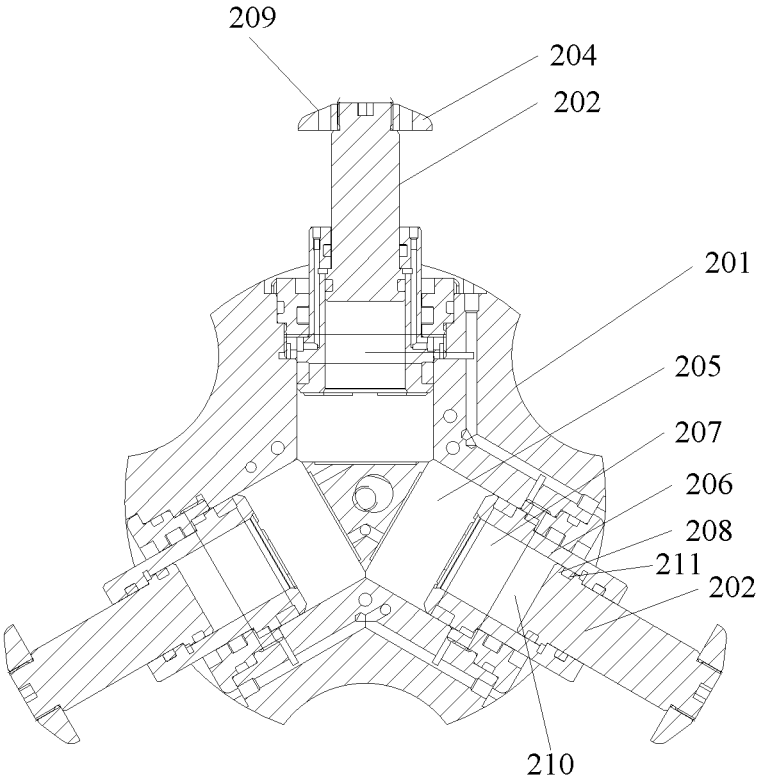
FIG. 3 is a schematic cross-sectional structural view taken along a direction A-A in FIG. 2.

As shown in FIG. 1, FIG. 2 and FIG. 3, an embodiment of the present application provides a sampling-by-pushing system, which may include a setting-by-pushing mechanism 1 and a centralizing device 2, and the setting-by-pushing mechanism 1 and the centralizing device 2 may be connected through a connecting pipe 3. The setting-by-pushing mechanism 1 is arranged to be set and sealed in the borehole to measure the fluid pressure inside the formation and extract a fluid sample from formation. The centralizing device 2 may include a base body 201 and a retractable support arm 202 which is provided on the base body 201 and may be retractable at the periphery of the base body 201.

After the sampling-by-pushing system is lowered into the borehole, the support arm 202 can extend out and contact with the wall of the borehole to centralize the setting-by-pushing mechanism 1, so that the setting-by-pushing mechanism 1 is centered in the borehole, i.e., the setting-by-pushing mechanism 1 is positioned in the center of the borehole through the extension and retraction of the support arm 202, thus providing a premise for good setting of the setting-by-pushing mechanism 1. In addition, since the sampling-by-pushing system of the embodiment of the present application can achieve centralizing of the setting-by-pushing mechanism 1 by the centralizing device 2, the sampling-by-pushing system of the embodiment of the present application can be suitable for working in a highly inclined or horizontal borehole, which enlarges the application range of the sampling-by-pushing system of the embodiment of the present application. Besides, the sampling-by-pushing system of the embodiment of the application also has the advantages of compact in structure, stable and reliable in performance and the like.

As shown in FIGS. 2 and 3, the base body 201 in the centralizing device 2 may be a cylindrical body, and each of the two ends of the base body 201 may be provided with a joint 203 for threadedly connecting with the connecting pipe 3.

The base body 201 may be provided with a plurality of mounting holes 205 at intervals along its circumferential direction, for example, 3, 4, 5 or more. The plurality of mounting holes 205 may be uniformly distributed along the circumferential direction of the base body 201 and may extend along the radial direction of the base body 201. A slidable support arm 202 is provided in the mounting hole 205 so that the support arm 202 can be extended and retracted.

The mounting hole 205 may be covered with a top cover 206 with a through hole 207, and the support arm 202 may extend into the mounting hole 205 through the through hole 207 of the top cover 206. A flange 208 is provided at the bottom of the support arm 202 (i.e., at the end of the support arm 202 extending into the mounting hole 205), and may be sealed against the side wall of the mounting hole 205 to form a hydraulic chamber 210 between the flange 208 and the bottom of the mounting hole 205. The hydraulic chamber may be communicated with a liquid inlet in the base body 201.

A return spring 211 for resetting the support arm 202 may be provided between the flange 208 and the top cover 206.

In this embodiment, the operation principle of controlling the extension and retraction of the support arm 202 is as follows: filling the hydraulic chamber with liquid through the liquid inlet in the base body 201, increasing the pressure in the hydraulic chamber so as to push the support arm 202 to extend outwardly, and retracting the support arm 202 by means of the elastic force of the return spring after the pressure in the hydraulic chamber is relieved.

As shown in FIGS. 2 and 3, the support end of the support arm 202 (i.e., the end of the support arm 202 that extends out of the mounting hole 205 and is supported on the borehole wall) may be provided with a contact cap 204 having a contact surface 209 that is an arc-shaped surface and is arranged to contact with the borehole wall. In the embodiment of the present application, by controlling the extension and retraction of the support arm 202 of the centralizing device 2, the contact cap 204 is abutted against the borehole wall, so as to centralize the setting-by-pushing mechanism 1 and thus position the setting-by-pushing mechanism 1 in the center of the borehole.

For example, in on-site operation, there are boreholes generally having a diameter of 8.5 inches or 12.2 inches. For the borehole having a diameter of 8.5 inches, the support arm 202 is arranged in a retracted state so that the setting-by-pushing mechanism 1 is centralized by the dimension of the base body 201. For the borehole having a diameter of 12.2 inches, the support arm 202 is extended so that the setting-by-pushing mechanism 1 is positioned at the center of the borehole by means of the support arm 202.

As shown in FIG. 1, the upper and lower ends of the setting-by-pushing mechanism 1 can be respectively connected with centralizing devices 2, i.e., an upper centralizing device 21 and a lower centralizing device 22. The upper centralizing device 21 and the lower centralizing device 22 are respectively used for centralizing the upper end and the lower end of the setting-by-pushing mechanism 1, thereby ensuring the setting-by-pushing mechanism 1 is positioned in the center.

Figure 4:
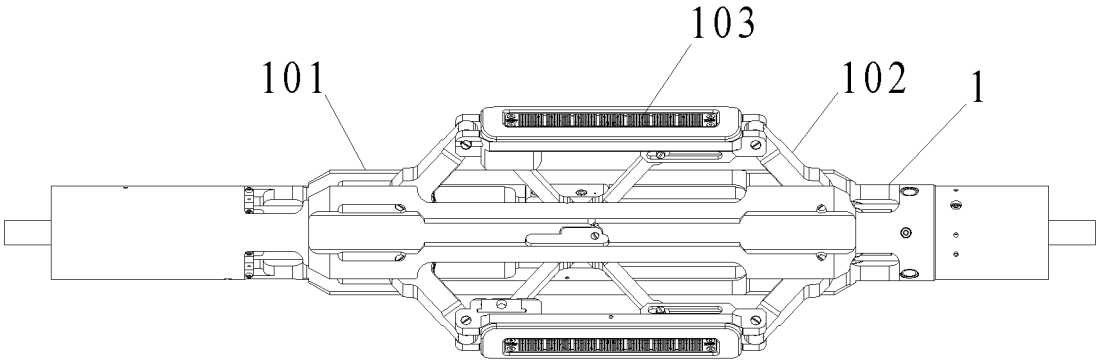
FIG. 4 is a schematic structural view of a setting-by-pushing mechanism in the embodiment of the application.

As shown in FIG. 4, the setting-by-pushing mechanism 1 may include a body 101 provided thereon with one or more sets of pushing arms 102 along the circumferential direction of the body 101. The pushing arm 102 may be articulated with a sealing probe 103 configured to be driven by the pushing arm 102 to contact with the borehole wall, thereby realizing the setting and sealing. The sealing probe 103 may be provided with a fluid inlet, which may be rectangular, oblong or square and the like in shape and is used to extract a fluid sample from the formation.

Figure 5:
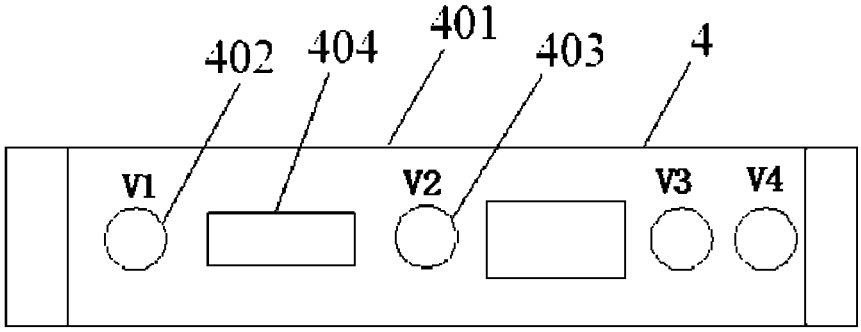
FIG. 5 is a schematic structural view of a control mechanism in the embodiment of the application.

As shown in FIGS. 1 and 5, the sampling-by-pushing system provided by an embodiment of the present application may further include a control mechanism 4, which may be connected with the centralizing device 2 for controlling the extension and retraction of the support arm 202 through a hydraulic control system.

The control mechanism 4 may include a base plate 401 provided thereon with a first integrated valve 402, a second integrated valve 403, and an accumulator 404. The first integrated valve 402 may be used to control the retraction of the support arm 202, the second integrated valve 403 may be used to control the extension of the support arm 202, and the accumulator 404 may be used to control the emergency retraction of the support arm 202, i.e., to automatically retract the support arm 202 when an accident occurs in downhole operation to ensure operation safety.

By the operation of the second integrated valve 403, the hydraulic control system can be controlled to fill the hydraulic chamber with liquid so as to push the support arm 202 out. By the operation of the first integrated valve 402, the hydraulic control system can be controlled to relieve the pressure in the hydraulic chamber, and the support arm 202 can be retracted by means of the return spring.

As shown in FIGS. 1 and 5, the control mechanism 4 may include an upper control mechanism 41 and a lower control mechanism 42, which may be connected to the upper centralizing device 21 and the lower centralizing device 22, respectively.

The upper control mechanism 41 can control the extension, retraction and safety emergency retraction of the support arm of the upper centralizing device 21. In addition, the upper control mechanism 41 can also be used to control the pushing, setting and safety emergency retraction of the sealing probe 103 in the setting-by-pushing mechanism 1.

The upper control mechanism 41 may include a base plate, a circuit control part, a first integrated valve, a second integrated valve, a third integrated valve, an accumulator, a sensor, and upper and lower joints. The circuit control part may include a high temperature and pressure resisting component, a pressure resisting housing, and a control circuit board, and may be used to control an electromagnetic valve located at the fluid inlet of the sealing probe 103 in the setting-by-pushing mechanism 1. The first integrated valve can be used to control the retraction of the sealing probe 103 of the setting-by-pushing mechanism 1, the retraction of the support arm of the upper centralizing device 21, the emergency pressure relief, etc. The accumulator can be used for the automatic retraction of the support arm when an accident occurs in downhole operation of the upper centralizing device 21, so as to ensure the operation safety. The second integrated valve can control the extension of the support arm of the upper centralizing device 21. The third integrated valve can be used to control the pushing of the sealing probe 103 of the setting-by-pushing mechanism 1.

The lower control mechanism 42 can be used to control the extension, retraction and safety emergency retraction of the support arm of the lower centralizing device 22, and can also control the flow direction, pressure measurement of the fluid within the sealing probe 103 of the setting-by-pushing mechanism 1, borehole diameter measurement, etc.

The lower control mechanism 42 may include a base plate, a circuit control part, five integrated valves (i.e., a first integrated valve, a second integrated valve, a third integrated valve, a fourth integrated valve, a fifth integrated valve), an accumulator, three mechanical valves, three quartz pressure sensors, and upper and lower joints.

The circuit control part of the lower control mechanism 42 may include a high temperature and pressure resisting component, a pressure resisting housing, a control circuit board, and may cooperate with the circuit control part of the upper control mechanism 41 to control together the electromagnetic valve at the fluid inlet of the sealing probe 103 in the setting-by-pushing mechanism 1, thereby controlling the flow direction of the fluid within the sealing probe 103 of the setting-by-pushing mechanism 1. In addition, the circuit control part of the lower control mechanism 42 can also be used to collect data from the displacement sensor arranged on the sealing probe 103 and thus obtain data about the borehole diameter.

The first integrated valve of the lower control mechanism 42 can be used to control the retraction of the support arm of the lower centralizing device 22, and emergency pressure relief, etc. The first integrated valve of the lower control mechanism 42 can also cooperate with the first integrated valve of the upper control mechanism 41 to control together the retraction of the sealing probe 103 in the setting-by-pushing mechanism 1. For example, the first integrated valve of the upper control mechanism 41 may control the retraction of some of the sealing probes 103, and the first integrated valve of the lower control mechanism 42 may control the retraction of the remaining sealing probes 103.

The second integrated valve of the lower control mechanism 42 can be used to control the extension of the support arm of the lower centralizing device 22. The accumulator of the lower control mechanism 42 can be used to automatically retract the support arm when an accident occurs in downhole operation of the lower centralizing device 22, so as to ensure operation safety. The third, fourth, and fifth integrated valves of the lower control mechanism 42 can be respectively combined with three mechanical valves for controlling the communication between the sealing probe 103 in the setting-by-pushing mechanism 1 and the external fluid. The three quartz pressure sensors can be used to monitor the pressure of the fluid entering the sealing probe 103.

Figure 6:
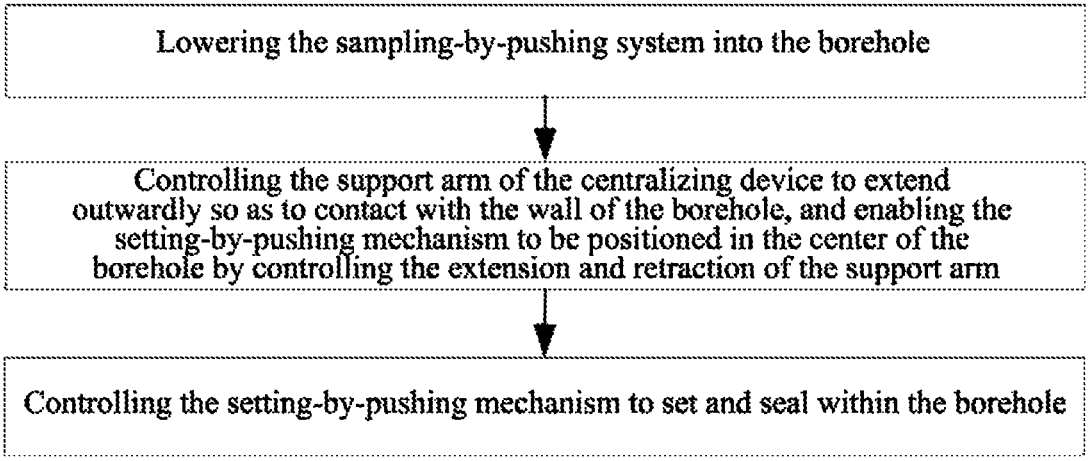
FIG. 6 is a flowchart of a method for setting the sampling-by-pushing system provided by an embodiment of the present application.

As shown in FIG. 6, an embodiment of the present application also provides a method for setting the aforementioned sampling-by-pushing system, including: lowering the sampling-by-pushing system into the borehole; controlling the support arm of the centralizing device to extend outwardly so as to contact with the wall of the borehole, and enabling the setting-by-pushing mechanism to be positioned in the center of the borehole by controlling the extension and retraction of the support arm; and controlling the setting-by-pushing mechanism to set and seal within the borehole.

After the sampling-by-pushing system is lowered into the borehole and reaches the target layer, the support arms of the upper and lower centralizing devices are extended to contact with the wall of the borehole, so that the setting-by-pushing mechanism is positioned in the center of the borehole. The sealing probe of the setting-by-pushing mechanism is actuated to realize the setting and sealing against the borehole. The fluid inlet of the sealing probe is opened based on the physical properties of the reservoir, and the fluid in the formation is extracted by means of a pump, so as to measure the pressure and take sample. After the operation is completed, the sealing probe and the upper and lower centralizing devices are retracted.

In the process of controlling the retractable support arm to locate the setting-by-pushing mechanism in the center of the borehole, when the setting-by-pushing mechanism is deviated from the center of the borehole toward one side, the support arm on that side is controlled to extend outwardly, and the support arm on opposite side is retracted, so that the setting-by-pushing mechanism is centralized in the borehole.

The sampling-by-pushing system can achieve a good setting effect and is suitable for boreholes with various inclination angles.

While the embodiments of the application are disclosed as above, the foregoing embodiments are merely used for facilitating understanding of the present application, and are not intended to limit the present application. A person skilled in the art to which this application pertains can make any modification and change in the forms and details of the embodiments without departing from the spirit and scope of the present application, while the patent protection scope of the present application shall be defined by the appended claims.

What we claim is:

1. A sampling-by-pushing system, comprising a setting-by-pushing mechanism and a centralizing device, wherein the setting-by-pushing mechanism is connected with the centralizing device through a connecting pipe, and is configured to be set and sealed in a borehole, and wherein the centralizing device comprises a base body and a retractable support arm arranged on the base body, the support arm being configured to be in contact with a wall of the borehole so as to position the setting-by-pushing mechanism in the center of the borehole;

wherein the base body is cylindrical in shape and along a circumferential direction thereof is arranged at intervals with a plurality of mounting holes to which the support arms are slidably connected;

wherein the mounting hole is covered by a top cover with a through hole through which the support arm extends into the mounting hole, the end of the support arm extending into the mounting hole being provided with a flange, a hydraulic chamber is formed between the flange and the bottom of the mounting hole and communicated with a liquid inlet in the base body.

2. The sampling-by-pushing system according to claim 1, wherein a return spring is provided between the flange and the top cover.

3. The sampling-by-pushing system according to claim 1, wherein a support end of the support arm is provided with a contact cap.

4. The sampling-by-pushing system according to claim 3, wherein the contact cap has a contact surface which is an arc-shaped surface and is arranged to contact with the wall of the borehole.

5. The sampling-by-pushing system according to claim 1, further comprising a control mechanism for controlling the extension and retraction of the support arm.

6. The sampling-by-pushing system according to claim 5, wherein the control mechanism controls extension and retraction of the support arm through a hydraulic control system.

7. The sampling-by-pushing system according to claim 5, wherein the control mechanism comprises a base plate provided thereon with a first integrated valve, a second integrated valve and an accumulator, wherein the first integrated valve is configured for controlling retraction of the support arm, the second integrated valve is configured for controlling extension of the support arm, and the accumulator is configured for controlling emergency retraction of the support arm.

8. The sampling-by-pushing system according to claim 1, wherein each of both ends of the setting-by-pushing mechanism is connected with a centralizing device.

9. The sampling-by-pushing system according to claim 8, further comprising two control mechanisms, each being configured for controlling the extension and retraction of the support arm of one of the two centralizing devices.

10. The sampling-by-pushing system according to claim 1, wherein the setting-by-pushing mechanism comprises a body on which one or more sets of pushing arms are arranged along the circumferential direction of the body, the pushing arm is articulated with a sealing probe and drives the sealing probe to contact with the wall of the borehole.

11. A method for setting the sampling-by-pushing system of claim 1, comprising:

lowering the sampling-by-pushing system into the borehole;

controlling the support arm of the centralizing device to extend outwardly so as to contact with the wall of the borehole, and enabling the setting-by-pushing mechanism to be positioned in the center of the borehole by controlling the extension and retraction of the support arm; and controlling the setting-by-pushing mechanism to set and seal within the borehole.

* * * * *